US009203194B2

(12) United States Patent
Yu

(10) Patent No.: US 9,203,194 B2
(45) Date of Patent: Dec. 1, 2015

(54) ELECTRICAL CONNECTOR

(71) Applicant: HON HAI PRECISION INDUSTRY CO., LTD., New Taipei (TW)

(72) Inventor: Jian Yu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 31 days.

(21) Appl. No.: 14/037,694

(22) Filed: Sep. 26, 2013

(65) Prior Publication Data

US 2014/0087589 A1 Mar. 27, 2014

(30) Foreign Application Priority Data

Sep. 26, 2012 (CN) ..... 2012 1 0366849

(51) Int. Cl.

| | |
|---|---|
| ***H01R 13/6594*** | (2011.01) |
| ***H01R 13/6587*** | (2011.01) |
| ***H01R 13/6596*** | (2011.01) |
| ***H01R 13/6599*** | (2011.01) |
| *H01R 12/72* | (2011.01) |

(52) U.S. Cl.

CPC ..... *H01R 13/6594* (2013.01); *H01R 13/6587* (2013.01); *H01R 13/6599* (2013.01); *H01R 12/724* (2013.01); *H01R 13/6596* (2013.01)

(58) Field of Classification Search

CPC ..... H01R 23/688; H01R 13/514; H01R 13/65807

USPC ..... 439/541.5, 607.02, 607.05–607.11, 439/607.39, 607.47, 701

See application file for complete search history.

(56) References Cited

U.S. PATENT DOCUMENTS

| | | | | |
|---|---|---|---|---|
| 6,743,057 | B2 * | 6/2004 | Davis et al. | 439/701 |
| 6,899,566 | B2 | 5/2005 | Kline et al. | |
| 7,416,447 | B1 * | 8/2008 | Chen | 439/607.05 |
| 7,585,186 | B2 | 9/2009 | McAlonis et al. | |
| 7,785,148 | B2 | 8/2010 | Pan | |
| 7,811,128 | B2 | 10/2010 | Pan | |
| 7,862,376 | B2 * | 1/2011 | Sypolt et al. | 439/607.07 |
| 2012/0077380 | A1 * | 3/2012 | Minich et al. | 439/607.05 |
| 2012/0214343 | A1 * | 8/2012 | Buck et al. | 439/607.05 |
| 2013/0102192 | A1 * | 4/2013 | Davis | 439/607.07 |
| 2013/0130550 | A1 | 5/2013 | Wozniak | |

* cited by examiner

*Primary Examiner* — Amy Cohen Johnson
*Assistant Examiner* — Matthew T Dzierzynski
(74) *Attorney, Agent, or Firm* — Ming Chieh Chang; Wei Te Chung

(57) ABSTRACT

An electrical connector (1000) includes a number of frames (10). The frame includes a dielectric holder (3) holding a number of signal contacts (23), and a ground shield (2) including a base plate (20) coupled to the dielectric holder. The ground shield includes a number of mating sections (221) extending forwardly from a front edge of the base plate and parallel to a mating portion (231) of the signal contact. A number of grounding tails (214) are separately mounted into the bottom side of the holder and aligned to the mounting portion of the signal contacts. The ground shield further includes a front tail (211) extending downwardly along the base plate, and a number of connecting legs (213) each extending sideward adjacent a bottom edge of the base plate into the holder for electrically connecting with the grounding tail.

1 Claim, 7 Drawing Sheets

ELECTRICAL CONNECTOR

BACKGROUND OF THE INVENTION

1. Field of the Invention

The present invention relates to an electrical connector having a grounding plate structure, and more particularly to an electrical connector having an improved grounding plate structure featured by mounting tails.

2. Description of Related Art

U.S. Pat. No. 7,585,186 issued to McAlonis et al. on Sep. 8, 2009 discloses an electrical connector including a plurality of contact module assemblies. Each assembly includes a dielectric body, a plurality of contacts received by the body, and a commoning member laterally attached to one side of the body. The contacts include signal contacts and grounding contacts, each having a mating and mounting segments respectively alignedly extending out of a front edge and a bottom edge of the dielectric body. The mating and mounting segments of the grounding contacts are electrically separated and spaced apart from each other by a gap. The commoning member electrically connects the mating and mounting segments of the ground contacts.

U.S. Pat. No. 7,811,128 issued to Pan on Oct. 12, 2010 discloses an electrical connector including a plurality of terminal modules. The terminal module includes a dielectric base and receives a plurality of signal contacts and a grounding or shielding plate of either a first or second type. The signal contact includes a mating portion extending out of a front edge of the base, and a mounting portion extending out of a bottom edge of the base. The grounding plate has a plurality of mating sections adapted for approximately parallel to and horizontally aligned to the mating portions of the signal contacts. Only one of the first type grounding plate and the second type grounding plate has a plurality of mounting tines extending downwardly. The first shielding plate and the second shielding plate are alternately arranged and two adjacent plates are electrically connected together.

U.S. Patent Application Publication No. 2013/0130550 discloses an electrical connector including a plurality of wafers. Each wafer has an insulative housing, a shield plate coupled to the housing, and a plurality of signal conductors disposed in the housing. Each signal conductor includes a contact end extending out of a mounting side of the housing and aligned with one another in a column. The shield plate has a plurality of board mounting ends bent and extending into the column to align with the contact ends of the signal conductors in a substantially straight line. At least one of the board mounting ends of the shield plate is formed by so bending that a body portion thereof is approximately perpendicular to the plane of the shield plate, and toward the signal conductors when assembled, to result in a strong contact end.

An electrical connector having an improved grounding plate structure is desired.

SUMMARY OF THE INVENTION

Accordingly, an object of the present invention is to provide an electrical connector having an improved grounding plates.

In order to achieve the object set forth, an electrical connector in accordance with the present invention includes a front housing defining a receiving space and a contact module including a plurality of frames partially received in the receiving space, each frame comprising: a dielectric holder; a plurality of pairs of signal contacts mounted in said holder, each of the signal contacts including a mating portion outward extending from a front edge of the holder, a mounting portion downward extending from a bottom edge of the holder, and a middle portion between the mating portion and the mounting portion, the mounting portions arranged in a column; a ground shield including a base plate coupled to the dielectric holder and a plurality of mating sections extending forwardly over a front edge of the base plate, each mating section positioned adjacent and approximately parallel to a corresponding mating portion of the signal contact; and a plurality of grounding tails separately embedded in the bottom edge of the holder and aligned to said column; wherein the ground shield further includes a front tail extending downwardly from the base plate, and a plurality of connecting legs each extending sidewardly from the base plate to connect with a corresponding grounding tail.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
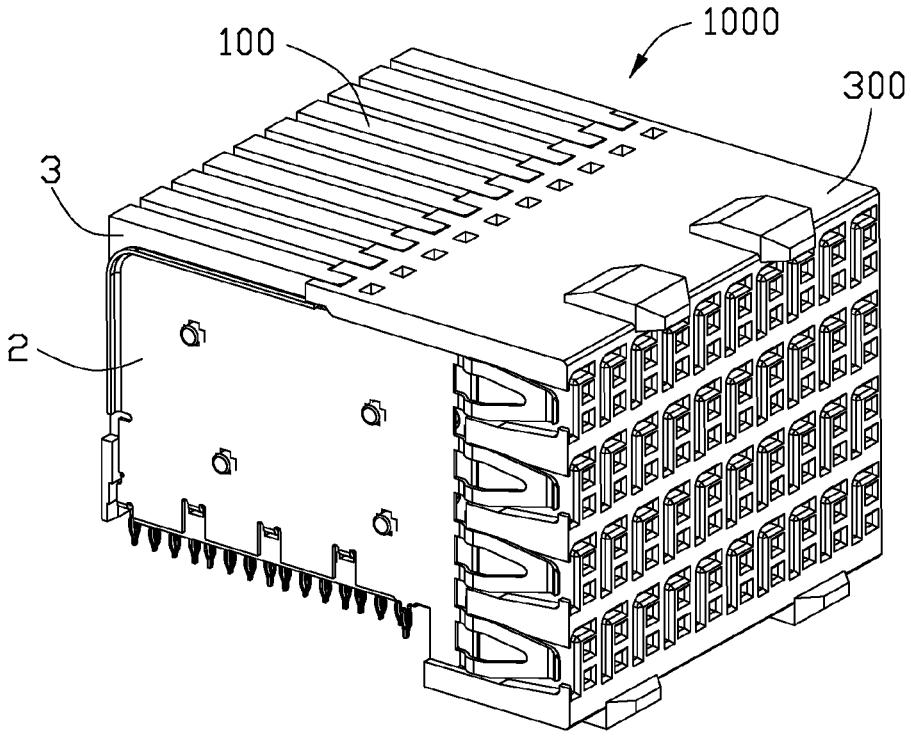
FIG. 1 is an assembled perspective view showing an electrical connector in accordance with the present invention.
Figure 2:
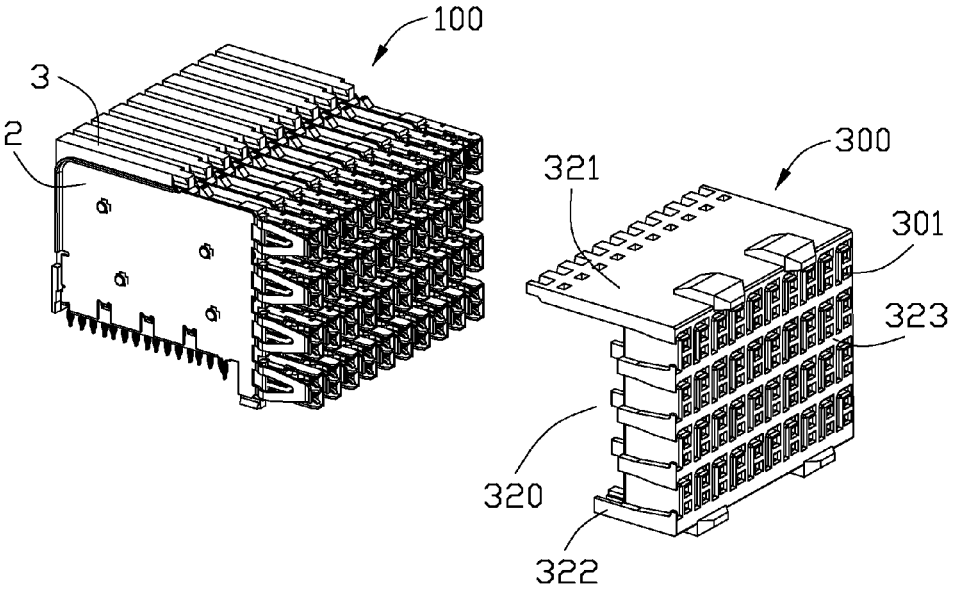
FIG. 2 is a partially assembled perspective view showing the electrical connector shown in FIG. 1, with a contact module separated from a front housing.
Figure 3:
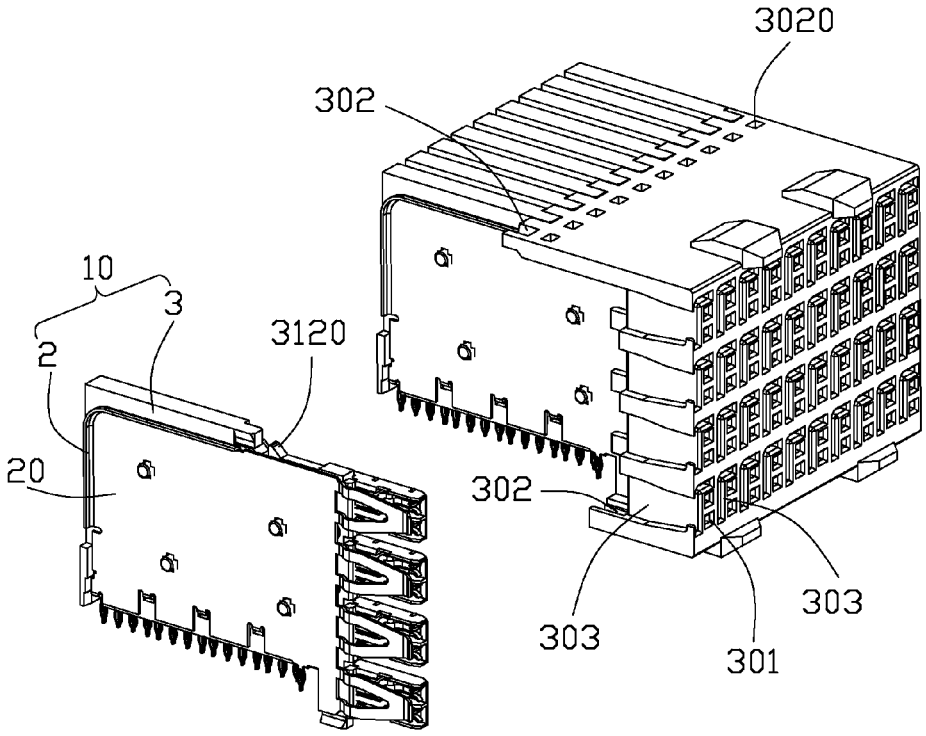
FIG. 3 is another partially assembled perspective view showing the electrical connector shown in FIG. 1, with a frame separated from a front housing.
Figure 4:
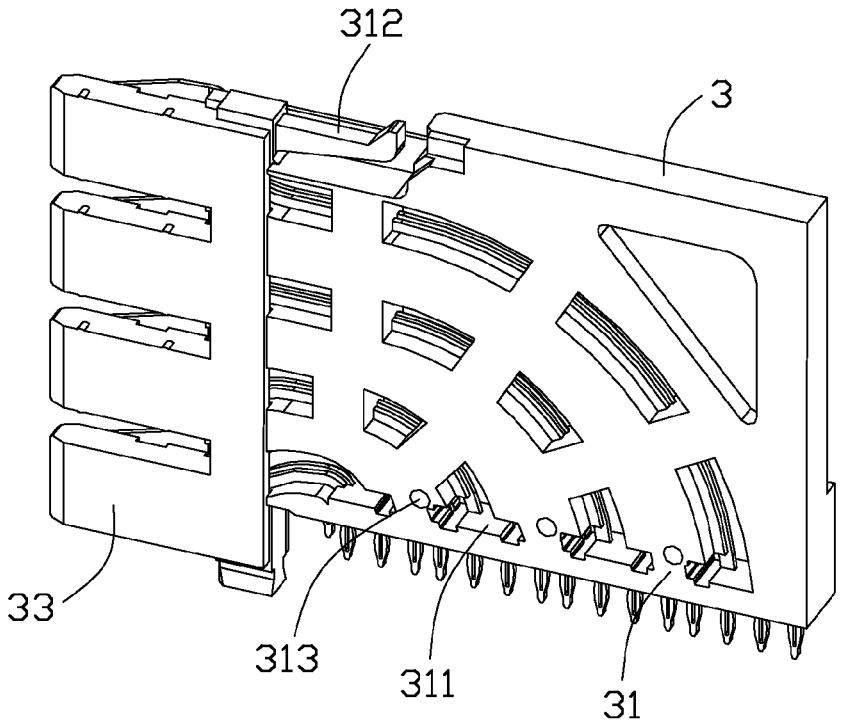
FIG. 4 is an assembled perspective view showing a frame as shown in FIG. 3, taken from another aspect.
Figure 5:
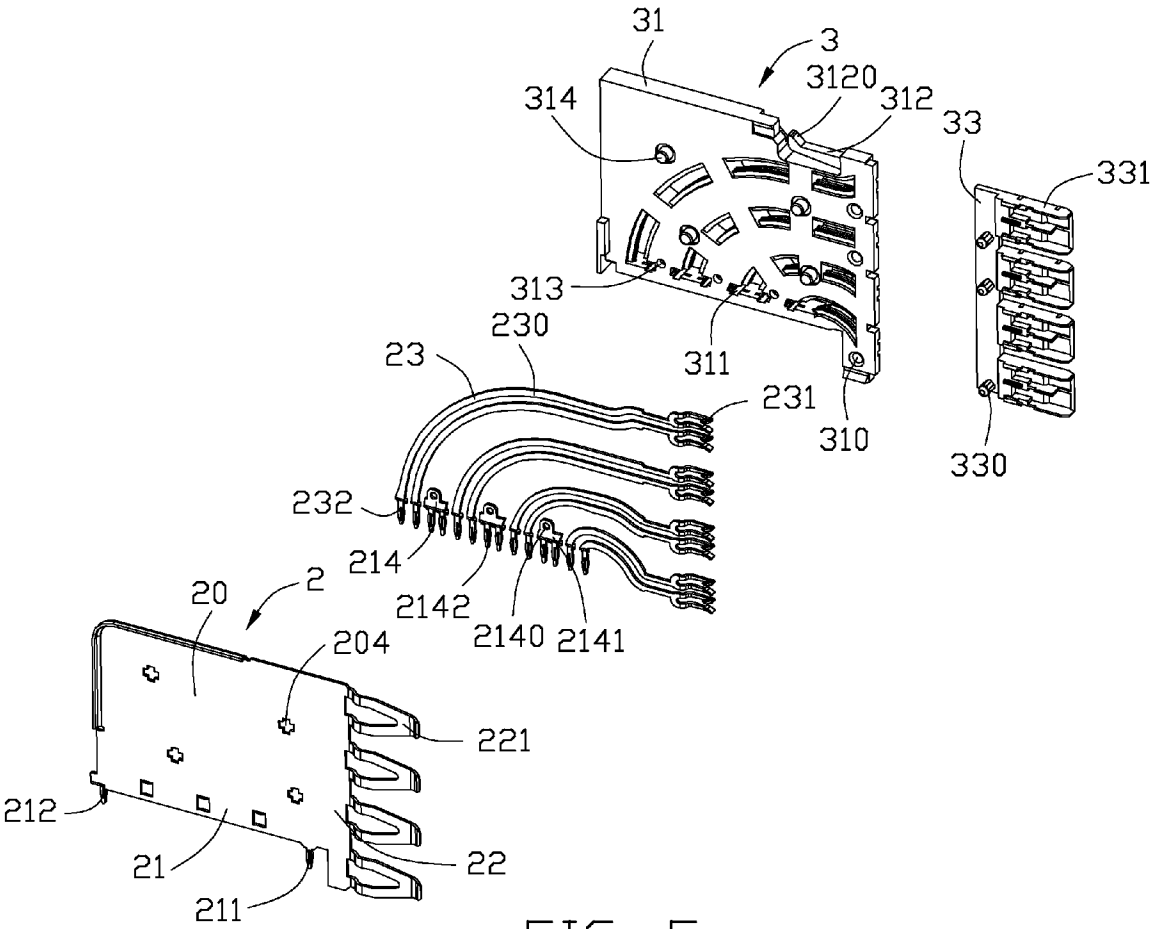
FIG. 5 is an exploded view showing the frame as shown in FIG. 3.
Figure 6:
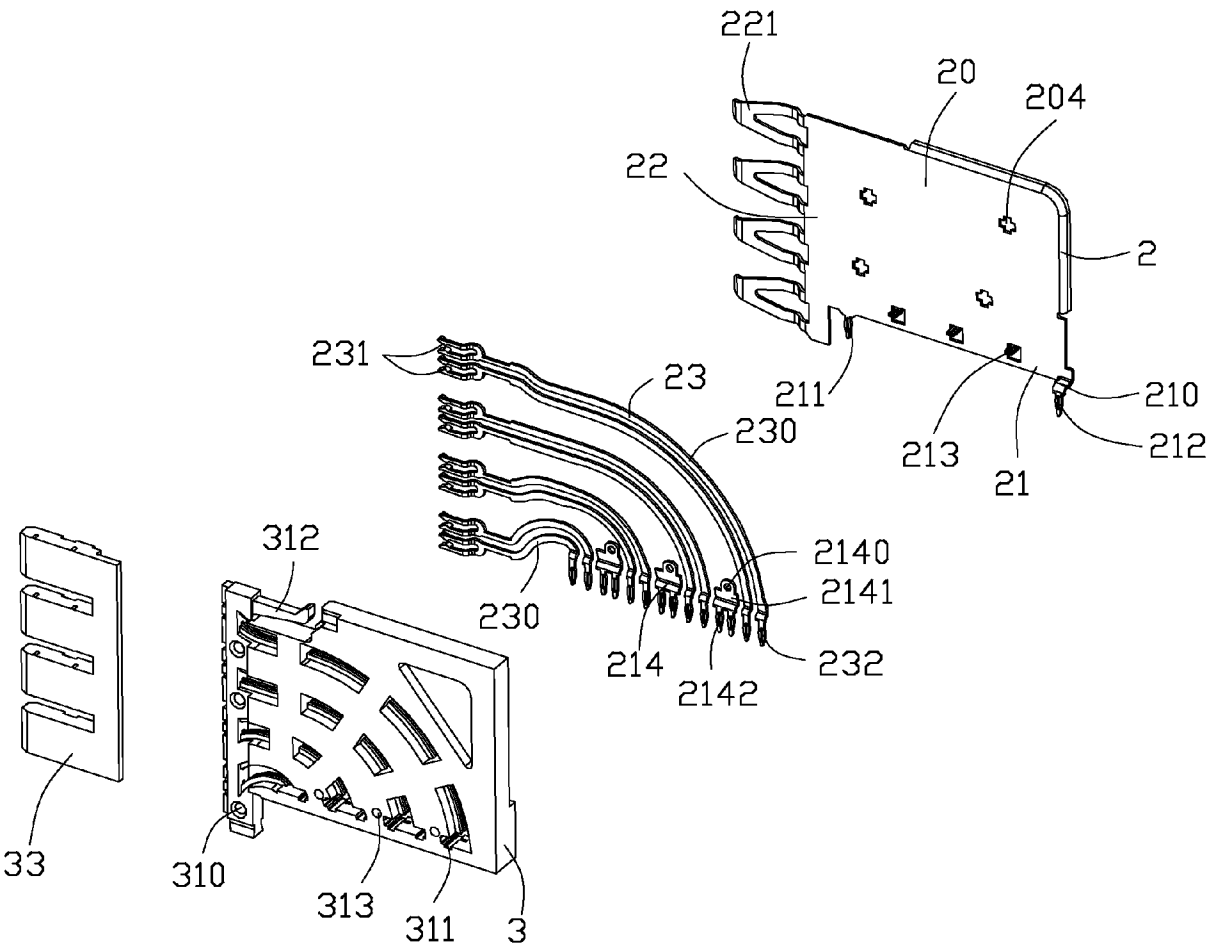
FIG. 6 is an exploded view showing the frame as shown in FIG. 5, taken from another aspect.
Figure 7:
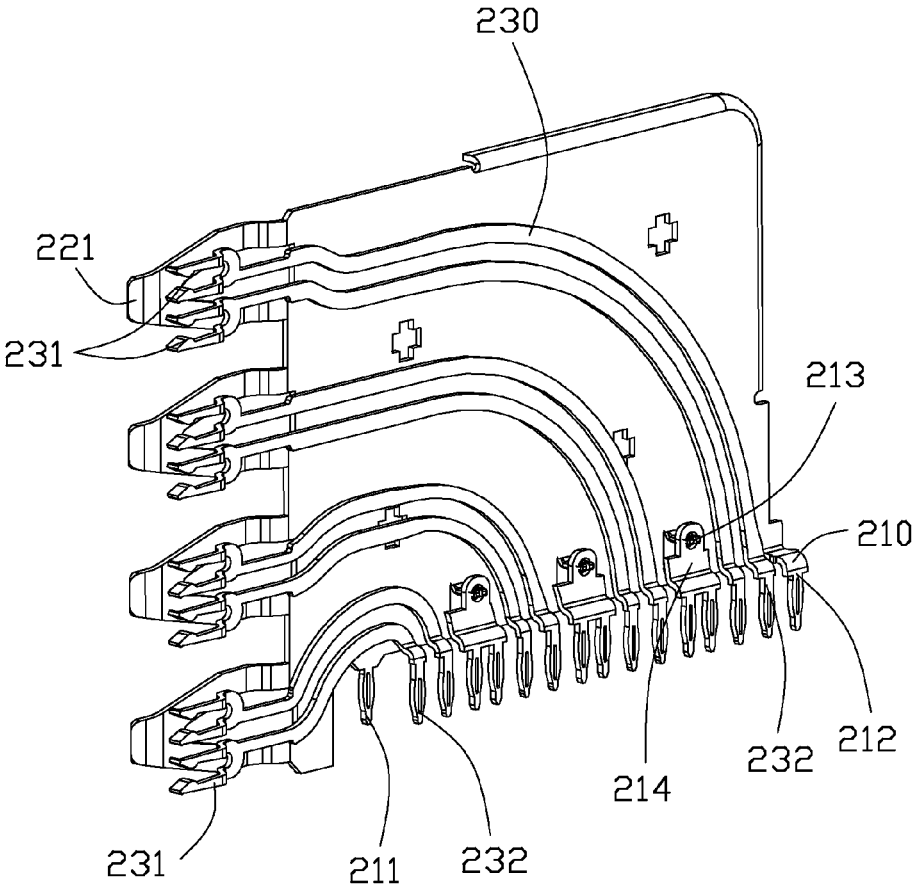
FIG. 7 is an assembled perspective view showing a frame as shown in FIG. 3, without a dielectric holder.

Referring to FIGS. 1-3, an electrical connector 1000 in accordance with the present invention is designed to be mounted to a printed circuit board. The electrical connector 1000 includes a front housing 300 and a contact module 100 engaged with the front housing 300. The front housing 300 includes a top wall 321, a bottom wall 322, and a front wall 323 extending between the top wall 321 and the bottom wall 322 to define a receiving space 320. The receiving space 320 opened backwardly for partially enclosing the contact module 100.

The top wall 321 and the bottom wall 322 each define a plurality of receiving slots 302 in the receiving space 320. The receiving slots 302 oppose to each other in pairs along an up-to-down direction. Each of the slots 302 positioned on the top wall 321 has at least one locking hole 3020 extending through the top wall 321. A plurality of signal cavities 301 and a plurality of grounding cavities 303 are provided in the front wall 323. Each of the grounding cavities 303 is defined laterally adjacent to a pair of signal cavities 301.

Referring to FIGS. 3-7, the contact module 100 includes a plurality of frames 10 stacked along a transverse direction. Each frame 10 is inserted into a pair of receiving slots 302 which respectively come from the top wall 321 and the bottom wall 322. The frame 10 includes a wafer 3 and a ground shield 2 laterally coupled to the wafer 3. The wafer 3 includes a dielectric holder 31 and a plurality of signal contacts 23 insert-molded into the holder 31. The signal contacts 23 are divided into pairs for transmitting differential signals. Each of the pair of signal contacts 23 includes a mating portion 231 forwardly extending out of a front side of the holder 31 and respectively adapted to be received into each of the signal cavities 301, a mounting portion 232 extending downwardly from a bottom side of the holder 31 and beyond the bottom side, and a middle portion 230 extending from the mounting portion 232 to the mating portion 231.

The holder 31 has an elastic arm 312 defining a flange 3120 thereon. The elastic arm 312 is inwardly pressed by the receiving slot 302. The flange 3120 is adapted to be engaged with the locking hole 3020 when the wafer 3 is inserted into the front housing 300 together with the ground shield 2. The holder 31 further includes a first side and an opposite second side. One of the first side and the second side configured for mounting the ground shield 2 has a plurality of posts 314. These posts 314 are respectively interference fitted with a plurality of cavities 204 defined on the ground shield 2 so as to assemble the ground shield 2 to the holder 31.

The signal contacts 23 are manufactured by punching from a sheet metal, at the same time forming a plurality of grounding tails 214 integrally from the same sheet metal. The grounding tails 214 are disposed proximate to the mounting portions 232 of the signal contacts 23 and separating one pair of mounting portions 232 from another. All of the grounding tails 214 are aligned to the mounting portions 232 in a column Preferablely, the ground shield 2 is manufactured by punching from another sheet metal which can be manufactured at less cost.

The ground shield 2 includes a base plate 20 defining the cavities 204, a plurality of mating sections 221 extending forwardly from a front edge 22 of the base plate 20, a front tail 211 extending downwardly from a bottom edge 21 of the base plate 20, and a back tail 210 extending transversely towards the holder 31 and then downwardly from the bottom edge 21. Each of the mating sections 221 is adapted to be respectively received in each of the grounding cavities 303 and approximately parallel to the mating portion 231 of the signal contact 23. The front tail 211 is configured to be coplanar with the base plate 20. The back tail 210 is configured to shift apart from base plate 20, such that the back tail 210 has an end portion 212 aligned to the mounting portions 232 and the grounding tails 214. The ground shield 2 further includes a plurality of connecting legs 213 extending laterally from the base plate 20 adjacent the bottom edge 21. Each of the connecting legs 213 extends through into the holder 31 through a hole 313 on the holder 31 for electrically connecting with each of the grounding tails 214. All of the connecting legs 213 are formed between the front tail 211 and the back tail 210 in this embodiment.

The holder 31 has a plurality of openings 311 for receiving a plurality of punch tools (not shown). The grounding tails 214 could be separated from the signal contacts 23 by the punch tools after being integrally insert-molded into the holder 31. That is, the signal contacts 23 and the grounding tails 214 are still connected together after integrally punched off from the sheet metal. As can be understood, the grounding tails 214 can be accurately aligned with the mounting portions 232 in above process. These aligned contacts are convenient to be mounted into the outer printed circuit board. Each of the grounding tails 214 extends beyond the bottom side of the holder 31, but not out of the front side of the holder 31. Thus, the number of the contacts on the front side of the holder 31 is less than that on the bottom side. The different density of the contacts in each frame 10 is helpful to adjust the impedance of the electrical connector 1000.

In an exemplary embodiment, the wafer 3 further has a cover 33 engaged with the front side of the dielectric holder 31. Each cover 33 has a plurality of apertures 331 configured for receiving each pair of the mating portions 231 of the signal contacts 23, and a plurality of piles 330 each configured for engaging with a mounting hole 310 defined on the front side of the dielectric holder 31. The aperture 331 dielectrically separates the signal contacts 23 in each pair of the mating portions 231. Preferably, each of the grounding tails 214 includes a through hole 2140 for receiving the connecting leg 213, a base body 2141, and a pair of grounding terminals 2142 extending downwardly from the base body 2141.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a front housing defining a receiving space; and a contact module including a plurality of frames partially received in the receiving space, each frame comprising:

a dielectric holder;

a plurality of pairs of signal contacts mounted in said holder, each of the signal contacts including a mating portion outward extending from a front edge of the holder, a mounting portion downward extending from a bottom edge of the holder, and a middle portion between the mating portion and the mounting portion, the mounting portions arranged in a column;

a ground shield including a base plate coupled to the dielectric holder and a plurality of mating sections extending forwardly over a front edge of the base plate, each mating section positioned adjacent and approximately parallel to a corresponding mating portion of the signal contact; and a plurality of grounding tails separately embedded in the bottom edge of the holder and aligned to said column; wherein the base plate further includes a bottom edge being flush with the bottom edge of the holder, and a plurality of connecting legs each extending and split sidewardly from a corresponding opening of the base plate to connect with a corresponding grounding tail; wherein the connecting legs are upwardly spaced away from the bottom edge with a distance in a vertical direction for protection consideration.

* * * * *